United States Patent [19]

Bolick, Jr. et al.

[11] Patent Number: 4,481,379

[45] Date of Patent: Nov. 6, 1984

[54] SHIELDED FLAT COMMUNICATION CABLE

[75] Inventors: Virgil T. Bolick, Jr., Asheville; Kenneth W. Brownell, Jr., Enka, both of N.C.; Michael W. Elliott, Siloam Springs, Ark.

[73] Assignee: Brand-Rex Company, Willimantic, Conn.

[21] Appl. No.: 443,636

[22] Filed: Nov. 24, 1982

Related U.S. Application Data

[63] Continuation-in-part of Ser. No. 333,003, Dec. 21, 1981, abandoned.

[51] Int. Cl.[3] ..... H01B 11/00; H01B 7/08

[52] U.S. Cl. ..... 174/36; 174/117 F; 174/121 A

[58] Field of Search ..... 174/36, 117 F, 117 FF, 174/121 A, 120 SR

[56] References Cited

U.S. PATENT DOCUMENTS

| | | | |
|---|---|---|---|
| 3,612,743 | 10/1971 | Angele | 174/36 |
| 3,663,739 | 5/1972 | Chevrier | 174/36 |
| 3,764,727 | 10/1973 | Balde | 174/34 |
| 3,775,552 | 11/1973 | Schumacher | 174/36 X |
| 4,062,998 | 12/1977 | Hagiwara et al. | 174/120 SR X |
| 4,287,385 | 9/1981 | Dombrowsky | 174/36 |
| 4,308,421 | 12/1981 | Bogese | 174/117 F X |

FOREIGN PATENT DOCUMENTS

| | | | |
|---|---|---|---|
| 17077 | 10/1980 | European Pat. Off. | 174/36 |
| 1913972 | 10/1970 | Fed. Rep. of Germany | 174/117 F |
| 2039873 | 2/1972 | Fed. Rep. of Germany | 174/120 SR |
| 2644252 | 3/1978 | Fed. Rep. of Germany | 174/117 F |
| 2754342 | 6/1979 | Fed. Rep. of Germany | 174/36 |
| 37880 | 4/1978 | Japan | 174/117 F |
| 38297 | 11/1979 | Japan | 174/121 A |
| 33568 | 9/1980 | Japan | 174/121 A |
| 354814 | 7/1961 | Switzerland | 174/117 F |

OTHER PUBLICATIONS

Mayer, H. A. et al.; New Generation of Non-halogenated, Flame Retardant Compounds and Cables; Proceedings of 29th International Wire & Cable Symposium; Conference Cherry Hill, N.J., USA; Nov. 18-20, 1980; pp. 253-262.

*Primary Examiner*—John Gonzales
*Assistant Examiner*—Morris H. Nimmo
*Attorney, Agent, or Firm*—David M. Carter

[57] ABSTRACT

There is provided an improved flat electrical communications cable which includes a plurality of coplaner pairs of elongated, insulated conductors. The pairs of conductors are embedded in a jacket which supports the cable and maintains the spacing among the conductors and pairs. The spacing between conductors in a pair is substantially less than the spacing between each adjacent pair. The jacket is thicker in the regions around each pair and thinner in the regions between each pair, thus forming the valleys and ridges on each side of the jacket. An elongated metal shield covers at least one side of the jacket. The shield conforms to and is contiguous with the valleys and ridges resulting in somewhat of a sinusoidal cross-sectional appearance of the shield. Each conductor includes a dual insulation, the inner insulation being made from a flame retardant material and the outer insulation being made from a different material from the jacket.

10 Claims, 3 Drawing Figures

SHIELDED FLAT COMMUNICATION CABLE

This application is a continuation-in-part of application Ser. No. 333,003 filed Dec. 21, 1981, now abandoned.

BACKGROUND OF INVENTION

This invention relates to an improved flat communications cable. More particularly, it relates to a shielded flat communications cable having improved cross-talk and longitudinal balance.

In multi-pair communications cable, a principal concern is to maintain pair-to-pair cross-talk at acceptable levels so that transmissions on one pair do not interfere with transmissions on an adjacent or nearby pair. The problem of cross-talk in round cables is solved somewhat by twisting together the conductors of each pair so that the electric fields are, to a certain extent, cancelled. Some telephone cables, particularly the larger varieties, that is 25 pair and above, have used metal screens and shields in order to reduce the cross-talk. One example is shown in U.S. Pat. No. 3,622,683 assigned to the Superior Continental Corporation. The Superior patent shows a metal screen dividing a multi-pair cable core into two halves.

With the advent of flat cable and particularly with the advent of extruded jackets, the communications cable industry has been turning more and more to flat construction. Flat cable has advantages over round cable, particularly in the ease of gang termination to a connector and furthermore, the conductor pairs are maintained in a fixed space relationship for ease of identification. Flat cables also have a low profile so that they can be installed under carpets. One of the problems in flat cable construction for communications cable is the difficulty in controlling cross-talk. The twisted-pair approach is not acceptable because it raises the profile of the cable and it is difficult to maintain proper electrical characteristics. One attempt at this type construction is disclosed in U.S. Pat. No. 3,764,727 issued to Western Electric Company; however, this construction is very difficult to manufacture.

Manufacturers of flat telephone and data cable have also utilized metal shields on either side of the flat cable such as the shields 10 and 12 in the cable shown in FIG. 1. Other examples of similarly shielded flat cables are shown in the 1969 edition of the "Tape Cable, Flat Cable Bulletin".

Another type of shielded flat cable is shown in U.S. Pat. No. 3,459,879 issued to Gerpheide. The Gerpheide patent shows a multi-conductor flat cable having a metal shield sewn to the top part of the cable. Yet another shielded flat cable is shown in U.S. Pat. No. 3,576,723 issued to Angele. The Angele patent shows the shielding which is somewhat of a ridge and valley construction between each conductor.

OBJECTS OF THE INVENTION

It is therefore one object of this invention to provide an improved shielded, flat communications cable.

It is another object to provide a multi-pair flat communications cable having improved cross-talk reduction.

It is another object to provide a communications cable having improved longitudinal balance.

It is still another object to provide a flat cable in which the conductors are flame retardant and are easily stripped from the cable jacket.

SUMMARY OF THE INVENTION

In accordance with the form of this invention there is provided an electrical communications cable having at least first and second substantially coplaner pairs of elongated insulated conductors. Each conductor in a pair is closely spaced with respect to the other. The pairs are embedded in an elongated jacket which supports the cable and maintains the spacing among the conductors and pairs.

The jacket is thicker in the regions around each pair and thinner in the regions between the pairs, forming valleys and ridges on each side. An elongated metal shield substantially covers at least one side of the jacket. The shield conforms to and is substantially contiguous with the valleys and ridges on one side of the jacket.

The above-described construction results in a cable with substantially improved cross-talk and longitudinal balance characteristics.

Another feature of the invention is the utilization of a dual conductor insulation whereby the inner insulation is made from a flame retardant material and the outer insulation is made from a material different from the cable jacket.

BRIEF DESCRIPTION OF THE DRAWINGS

The subject matter which is regarded as the invention is more particularly set forth in the appended claims. The invention itself, however, together with further objects and advantages thereof, may be better understood by referring to the following description in conjunction with the accompanying drawings in which:

DESCRIPTION OF THE PREFERRED EMBODIMENT

Figure 2:
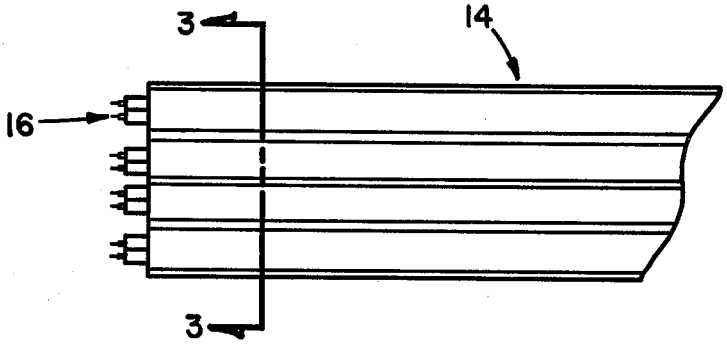
FIG. 2 is a partial plan view showing the cable of the subject invention.

Referring now more particularly to FIG. 2, there is provided flat cable 14 having four pairs of insulated conductors, one of which being indicated as pair 16.

Figure 3:
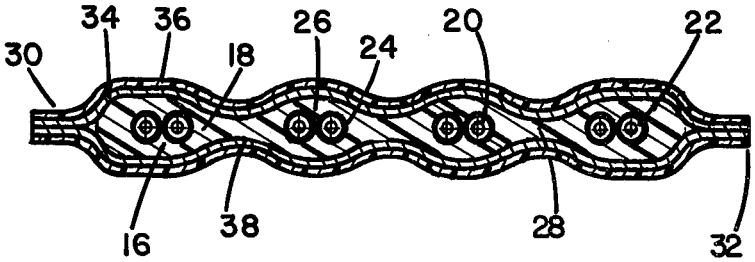
FIG. 3 is a cross-sectional view of the cable of FIG. 2 taken along the lines of 3-3.

Referring now to FIG. 3, the pairs of conductors 16 are coplaner and are embedded in a jacket 18. In the preferred embodiment, the jacket is made from polyvinylchloride (PVC), which is extruded about the pairs of conductors. In this embodiment, four pairs of conductors are shown; however, other numbers of conductors may also be utilized, such as for example, 25-pair flat cable. For simplicity sake, however, a four-pair cable is illustrated.

Each conductor in a pair includes wire 20 which may be made of copper, and in the preferred embodiment it is coated or insulated with a dual-insulation system. The insulation may be irradiated for toughness. The inner insulation 22 may be PVC, which is the same material as the jacket 18. Outer insulation 24 is preferably made of a different material from the jacket 18. In the preferred embodiments the outer insulation is a thin layer of polypropylene (PP) or polyethylene (PE), which are relatively inexpensive materials. One of the reasons that the outer insulation 24 is made from a different material is to avoid sticking between the insulation and jacket for ease of stripping. Thus the outer layer acts as a release member. One of the problems associated with the use of PE or PP is their flammability, particularly in cable insulation applications where the conductors are exposed when the cable jacket has been stripped. The above described dual PVC/PE or PVC/PP insulation system solves this problem in that PVC has flame retardant characteristics. In a high temperature situation or where the system is exposed to flame, the PVC will give off chlorine gas which increases the oxygen index of the system thus retarding the tendency of the thin outer layer to burn. In order words, the thick layer of flame retardant PVC (normally 5 mils) dominates the thin flammable layer of PE or PP (normally 1 mil).

As can be seen from FIG. 3, the extrusion of jacket 18 onto the pairs results in a thicker cross-sectioned portion of the jacket in the region around the pairs, indicated as 26, and a thinner portion in the region 28 between the pairs. Thus, the cross-sectional view of the cable looks like a sinusoid forming valleys and ridges.

Shielding tape 30 is laminated to both sides in the preferred embodiment, of the jacket 18. The tapes are sealed together at their outer edges 32. The tape 30 includes a metal shield 34 which, in the preferred embodiment is aluminum, and polyester film 36 on its top. Thus, the polyester film 36 insulates the shield. An additional layer over the top of this construction (not shown) may also be provided for additional electrical insulation.

As can be seen from FIG. 3, the aluminum shield 34 conforms with the contours of the jacket 18. The aluminum shield is substantially contiguous to the jacket in the regions of valleys 28 and the regions of ridges 26. Thus the shields on either side of the jacket are closer together in a valley and further apart on a ridge. The aluminum shield may be held to the jacket by means of an adhesive on the outer surface of the jacket.

The conformation of the shield to the contours of the jacket is accomplished by utilizing soft rubber rollers during the lamination process. This contrasts to the construction shown in FIG. 1 where a soft rubber roller was not used to form the shield 40 over the jacket 42.

Figure 1:
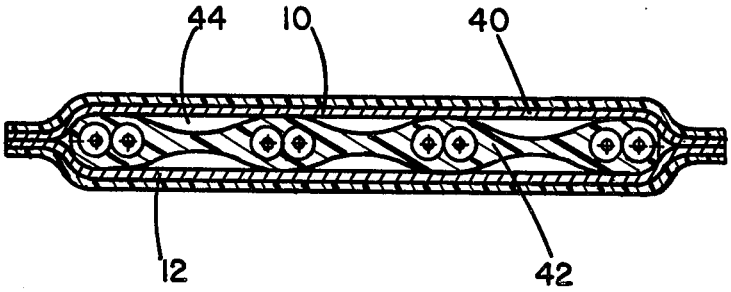
FIGURE 1 PRIOR ART
FIG. 1 is a cross-sectional view of a flat cable which utilizes a prior art shielding technique.

As can be seen from FIG. 1 where the shield does not conform to the contour of the jacket, air spaces 44 are formed between the shield and the jacket in the region of a valley. The soft rubber roller permits the ridged part of the jacket to extend into the roller during the lamination and further the roller will exert pressure on the shield to conform into the valley portion of the jacket.

It has been found that the cable construction shown in FIG. 3 is far superior in terms of near-end cross-talk and equivalent in longitudinal balance when compared to the cable of FIG. 1. It is is believed that the superiority as shown by the data below is due to the fact that the shield conforms to substantially all the contours of the jacket; thus, the shields on each side of the jacket are much closer together in the thin valley sections 28 than the thicker ridge section 26. Clearly this is not the case in the cable shown in FIG. 1.

The below data compares near-end cross-talk at 1 mHz between unshielded cable, the cable of FIG. 1, and the cable of FIG. 3, except that 25-pair cable was tested.

| Jacketed Pairs With no Shielding | | Flat Shielding | | Sinusoidal Shield | |
|---|---|---|---|---|---|
| Pair #1-2 | 30dB | Pair #1-2 | 42.4dB | Pair #11-12 | 50.4dB |
| Pair #2-3 | 33dB | Pair #2-3 | 40.4dB | Pair #12-13 | 51.0dB |
| Pair #3-4 | 36dB | Pair #3-4 | 40.5dB | Pair #13-14 | 50.6dB |
| | | Pair #1-4 | 68.0dB | Pair #21-24 | 68.0dB |

The below chart shows longitudinal balance and near-end cross-talk (N.E.X.T.) comparing a shielded cable of FIG. 1 with a shielded cable of FIG. 3. The readings were taken at 1 kHz, again with a 25-pair cable.

| 1kHz N.E.X.T. | | 1kHz Long. Bal. | |
|---|---|---|---|
| | FLAT SHIELD | | |
| Pair #1-2 | 95.87dB | Pair #1 | 89.24dB |
| Pair #2-3 | 93.19dB | Pair #2 | 97.03dB |
| Pair #3-4 | 93.29dB | Pair #3 | 100.81dB |
| | SINUSOIDAL SHIELD | | |
| Pair #11-12 | 107.55dB | Pair #11 | 91.42dB |
| Pair #12-13 | 108.44dB | Pair #12 | 88.76dB |
| Pair #13-14 | 108.44dB | Pair #13 | 88.76dB |

As can be seen from the above data, the cable construction of FIG. 3 shows a remarkable improvement over the construction shown in FIG. 1.

From the foregoing description of the illustrated embodiment of this invention, it will be apparent that many modifications may be made therein. It will be understood therefore that this embodiment of the invention is intended as an exemplification of the invention only and that the invention is is not limited thereto. It is to be understood that it is intended in the appended claims to cover all such modifications that shall fall within the true spirit and scope of the invention.

We claim:

1. An electrical communications cable comprising:

at least first and second substantially coplanar pairs of elongated insulated conductors; each conductor in a pair being closer to the other conductor of the pair than to any conductor of adjacent pairs of conductors; an elongated jacket; said pairs being embedded in said jacket; said jacket for supporting the cable and maintaining the spacing of said pairs of conductors; said jacket being thicker in the regions around each pair and thinner in the regions between each pair forming valleys and ridges on each side of the jacket; an elongated metal shield substantially covering at least one side of said jacket; said shield substantially conforming to and being contiguous with the valleys and ridges on at least one side of the said jacket; whereby pair to pair cross-talk is substantially reduced over a flat shielded cable.

2. A cable as set forth in claim 1 wherein said shield is on both sides of said jacket.

3. A cable as set forth in claim 1 wherein said shield is made from aluminum.

4. A cable as set forth in claim 1 wherein said insulation of each conductor is made from a different material than said jacket.

5. A cable as set forth in claim 4 wherein each conductor is insulated with two separate materials including an inner insulation contacting said conductor and an outer insulation contacting said inner insulation; said inner material being made of substantially the same material as the jacket material.

6. A cable as set forth in claim 5 wherein said jacket is made of polyvinylchloride and said outer insulation of said conductor is made of polyethylene or polypropylene.

7. A cable as set forth in claim 1 wherein said shield in cross-section forms a sinusoid shape.

8. A cable as set forth in claim 1 wherein said shield has an insulation material laminated thereto.

9. A cable as set forth in claim 1 wherein said first and second pairs are adjacent to one another; the distance between adjacent pairs being greater than the distance between conductors in a pair, and the thickness of said jacket being greater in the region around a pair than in the region between pairs.

10. A cable as set forth in claim 1 wherein the insulation of said insulated conductors is irradiated polyethylene.

* * * * *